US009863383B2

(12) United States Patent
Izzo

(10) Patent No.: US 9,863,383 B2
(45) Date of Patent: Jan. 9, 2018

(54) VALVE ASSEMBLY WITH A GUIDE ELEMENT

(71) Applicant: CONTINENTAL AUTOMOTIVE GMBH, Hannover (DE)

(72) Inventor: Ivano Izzo, Pisa (IT)

(73) Assignee: Continental Automotive GmbH, Hannover (DE)

( * ) Notice: Subject to any disclaimer, the term of this patent is extended or adjusted under 35 U.S.C. 154(b) by 0 days.

(21) Appl. No.: 15/053,094

(22) Filed: Feb. 25, 2016

(65) Prior Publication Data

US 2016/0245249 A1 Aug. 25, 2016

(30) Foreign Application Priority Data

Feb. 25, 2015 (EP) ..... 15156485

(51) Int. Cl.

| | |
|---|---|
| ***F02M 51/00*** | (2006.01) |
| ***F02M 61/12*** | (2006.01) |
| ***F02M 51/06*** | (2006.01) |
| ***F02M 61/18*** | (2006.01) |

(52) U.S. Cl.

CPC ..... *F02M 61/12* (2013.01); *F02M 51/061* (2013.01); *F02M 51/0625* (2013.01); *F02M 51/0671* (2013.01); *F02M 61/1806* (2013.01); *Y10S 239/90* (2013.01)

(58) Field of Classification Search

CPC .. F02M 61/12; F02M 51/0625; F02M 51/061; F02M 51/0671; F02M 61/1806; Y10S 239/90

USPC ..... 239/585.1, 585.4, 585.5, 533.11, 533.12, 239/900

See application file for complete search history.

(56) References Cited

U.S. PATENT DOCUMENTS

| | | | | |
|---|---|---|---|---|
| 6,039,272 | A | 3/2000 | Ren et al. | |
| 6,629,650 | B2 * | 10/2003 | Curran | F02M 51/0664 239/585.1 |
| 6,695,233 | B2 | 2/2004 | Sekine et al. | |
| 6,997,404 | B2 * | 2/2006 | Rao | F02M 51/0667 239/533.12 |
| 2004/0046062 | A1 | 3/2004 | Xu et al. | |
| 2009/0289131 | A1 | 11/2009 | Shingu et al. | |

FOREIGN PATENT DOCUMENTS

| | | | |
|---|---|---|---|
| EP | 0961881 | A1 | 12/1999 |
| EP | 1199465 | A2 | 4/2002 |
| JP | 2013104340 | A | 5/2013 |
| WO | 9835159 | A1 | 8/1998 |

* cited by examiner

*Primary Examiner* — Steven J Ganey

(74) *Attorney, Agent, or Firm* — Laurence A. Greenberg; Werner H. Stemer; Ralph E. Locher

(57) ABSTRACT

A valve assembly for a fluid injection valve contains a hollow valve body which hydraulically connects a fluid inlet to an injection orifice and has a longitudinal axis. A valve needle is received in the valve body in an axially displaceable fashion for sealing the injection orifice in a closing position. An electromagnetic actuator assembly is provided for displacing the valve needle away from the closing position, the actuator assembly containing a movable armature and a pole piece which is positionally fixed relative to the valve body. A guide element is positionally fixed relative to the pole piece, has a first guide surface for axially guiding the armature and a second guide surface for axially guiding the valve needle.

19 Claims, 7 Drawing Sheets

VALVE ASSEMBLY WITH A GUIDE ELEMENT

CROSS-REFERENCE TO RELATED APPLICATION

This application claims the priority, under 35 U.S.C. §119, of European patent application EP 15156485, filed Feb. 25, 2015; the prior application is herewith incorporated by reference in its entirety.

BACKGROUND OF THE INVENTION

Field of the Invention

The present disclosure relates to a valve assembly with a guide element for a fluid injection valve and to a fluid injection valve.

Fluid injection valves are used, for example, for injecting fuel into combustion chambers of internal combustion engines. Part-to-part and shot-to-shot variations of the injection characteristic of the fuel injectors have detrimental influence on fuel consumption and pollutant emission of the engine. Such variations may be introduced by manufacturing tolerances and in particular by long tolerance chains among several components.

SUMMARY OF THE INVENTION

It is an object of the present disclosure to provide an improved valve assembly for a fluid injection valve, enabling in particular comparatively small variations of the injection characteristic between different injection events and between different injectors of the same type.

According to one aspect, a valve assembly for a fluid injection valve is specified. According to a further aspect, a fluid injection valve containing the valve assembly is specified.

The valve assembly contains a hollow valve body which hydraulically connects a fluid inlet to one or more injection orifices and has a longitudinal axis. In particular, the valve body extends from the fluid inlet to the fluid outlet. The valve body may be closed at the fluid outlet except for the injection orifice(s), for example by a seat element of the valve body which is positioned at the fluid outlet and contains the injection orifice(s). For the sake of simplicity, the valve assembly may only be described in connection with one injection orifice in the following. However, the present disclosure also encompasses valve assemblies having a plurality of injection orifices.

The valve assembly further contains a valve needle which is received in the valve body. The valve needle is axially displaceable relative to the valve body in reciprocating fashion. The valve needle is configured for sealing the injection orifice in a closing position and for unsealing the injection orifice in other positions. In other words, the valve needle mechanically interacts with the valve body—in particular with the seat element—for sealing and unsealing the injection orifice. Expediently, the valve needle is in sealing contact with the seat element in the closing position and is axially displaceable away from the closing position to establish a gap between the valve needle and the seat element to enable fluid flow through the injection orifice.

Further, the valve assembly contains an electromagnetic actuator assembly for displacing the valve needle away from the closing position. The actuator assembly contains an armature and a pole piece. The pole piece is positionally fixed relative to the valve body while the armature is movable in reciprocating fashion relative to the pole piece and, thus, to the valve body. Preferably, the actuator assembly further contains a magnetic coil for generating a magnetic field to attract the armature towards the pole piece.

Further, the valve assembly contains a guide element which is positionally fixed relative to the pole piece. The guide element has a first guide surface for axially guiding the armature and a second guide surface for axially guiding the valve needle.

In this way, a particularly simple and precise guiding of the armature and the valve needle is achievable. In particular, a particularly precise parallel arrangement of impact surfaces of the armature and the pole piece—the impact surfaces of the armature and the pole piece facing towards and other and preferably being in mechanical contact in the fully open configuration of the valve assembly—is achievable by the guide element. Additional tolerances, for example by axially guiding the armature via the valve needle, can be avoided. Therefore, a particularly precise positioning of the valve needle relative to the armature may be unnecessary in case of the valve assembly of the present disclosure. Rather, both the valve needle and the armature are guided directly by the positionally fixed guide element.

In an expedient embodiment, the first and second guide surfaces are perpendicular to the mutually facing impact surfaces of the armature and the pole piece. Such perpendicular arrangement is particularly easily and precisely achievable with the valve assembly according to the present disclosure. The parallelism of the mutually facing impact surfaces of the armature and the pole piece is independent of manufacturing tolerances relating to the valve needle.

In one embodiment, the pole piece has a central axial opening in which the guide element is partially arranged and from which the guide element projects. In this way, a particularly precise positioning of the guide element and, consequently, of the armature relative to the pole piece is achievable.

In one embodiment, the guide element is in the shape of a sleeve, the first and second guide surfaces being comprised by an outer circumferential surface and an inner circumferential surface of the sleeve, respectively. The valve assembly may be configured such that fluid flows from the fluid inlet to the injection orifice through the sleeve. In one development, the guide element has a generally cylindrical outer surface and the first guide surface is represented by a portion of the cylindrical outer surface which projects from the pole piece. In another development, the guide element has a cylindrical shell, extending along the longitudinal axis with its cylindrical axis parallel to the longitudinal axis, and a lid portion extending radially inward from this cylindrical shell at one axial end thereof, in particular at that axial end which projects from the pole piece. The lid portion has an aperture in which a portion of the valve needle is received. A circumferential surface of the aperture may expediently represent the second guide surface. In this way, particularly precise guiding and/or particularly cost-effective manufacturing of the guide element are achievable.

In one embodiment, the valve needle contains a retainer element. The retainer element and the armature are operable to engage in a form-fit connection for displacing the valve needle away from the closing position. In one development, the retainer element mechanically interacts with the second guide surface of the guide element for axially guiding the valve needle. Preferably, the retainer element projects radially beyond a shaft of the valve needle. By means of the retainer element together with the guide element, a particularly precise axial guiding of the valve needle is achievable.

In particular, the retainer element of the valve needle and the lid portion of the guide element overlap in axial direction. Preferably, the retainer element has a curved shape at least in the region where it mechanically interacts with the guide element for axially guiding the valve needle. In this way, the risk that the retainer element and the guide element get jammed is particularly small.

In one embodiment, the armature retainer element has a spherical basic shape and the armature has a conical contact surface for engaging with the retainer element. In this way, the connection between the valve needle and the armature is particularly insensitive to manufacturing tolerances, in particular with respect to a tilt between the valve needle and the armature. At the same time, a curved surface of the retainer element for interacting with the guide element is achieved.

In one embodiment, the armature contains a main part and a bushing. The bushing and the main part are preferably made from different materials. In particular, the bushing is made from a material which is harder than the material from which the main part is made. The bushing may expediently be positioned radially between the valve needle and the main part in some places. The bushing preferably contains a contact surface of the armature—in particular the conical contact surface—which is in contact with the valve needle, in particular with the retainer element, for transferring a force to the valve needle to displace the valve needle away from the closing position.

In an expedient embodiment, at least one fluid channel is formed between the retainer element and the guide element. In one development, the aperture of the lid portion has a circular contour in top view along the longitudinal axis while the retainer element has a generally spherical basic shape provided with flats or axially extending recesses to establish gaps between the lid portion and the retainer element which represent fluid channels. In another development, the retainer element has a spherical shape—i.e. without flats or recesses in the region which axially overlaps the lid portion—while the lid portion contains the cutouts which extend axially through the lid portion for establishing fluid channels.

In one embodiment, the armature has a central recess. The guide element may in particular project axially from the pole piece into the central recess. A circumferential surface of the recess may expediently interact with the first guide surface of the guide element for axially guiding the armature. In one development, the retainer element is arranged in the central recess and the guide element is positioned radially between the retainer element and the armature at least in the region of the second guide surface. In this way, a particularly precise guiding of the armature and the valve needle is achievable. In the above context, "in the region of the second guide surface" refers in particular to those portions of the retainer element, the guide element, and the armature which have the same coordinates on the longitudinal axis as the second guide surface.

In one embodiment, the valve assembly further contains a calibration spring for biasing the valve needle towards the closing position. In one development, the calibration spring is at least partially arranged in the guide element, in particular in embodiments in which the guide element is in the shape of a sleeve. In a further development, one axial end of the calibration spring is seated against the retainer element. In particular in the case of the retainer element having a spherical basic shape, the calibration spring may advantageously be self-centering relative to the valve needle. An axial end of the calibration spring facing away from the valve needle may be seated against the calibration tube, which is preferably shifted into the central axial opening of the pole piece and, particularly preferably, connected thereto by a force-fit connection.

In another embodiment, the valve assembly contains an armature spring for biasing the armature away from the pole piece. In an expedient development, the armature spring is positioned in the recess of the armature and seated against the armature and the guide element at its opposite axial ends. In a further development, the armature spring is operable to move the armature out of contact with the retainer element when the valve needle is in the closing position so that the armature, when it is moving towards the pole piece, has to cover a so-called free lift before establishing the form fit connection with the retainer element and taking the valve needle with it.

In a further embodiment, the valve assembly further contains an armature stopper. In one embodiment, the armature stopper is generally disc shaped and has a central opening through which the valve needle extends. Preferably, it is distanced from the valve needle.

The armature stopper is arranged in the hollow valve body on the side of the armature remote from the pole piece. It is positionally fixed relative to the valve body. For example, it has a tubular portion on its side remote from the armature for establishing a form-fit connection and/or a force-fit connection and/or a welded connection with the valve body.

The armature stopper is operable to limit axial displacement of the armature away from the pole piece. In one development, the armature spring is configured for biasing the armature into contact with the armature stopper when the electromagnetic actuator assembly is de-energized.

In one development, the armature stopper is configured for hydraulically damping movement of the armature of a from the pole piece. For example, the armature stopper and the armature each have impact surfaces which face towards another, which are parallel, and which have an overlapping area of at least 25% of the cross-sectional area of the cavity of the valve body in the region of the impact surfaces. A particularly precise parallel orientation of the impact surfaces is achievable with the valve assembly according to the present disclosure. In particular, the parallelism of the impact surfaces of the armature and the armature stopper is independent from manufacturing tolerances relating to the valve needle. The parallelism between the impact surface of the pole piece—coming in contact with the armature in a fully open configuration of the valve assembly—and of the armature stopper—coming in contact with the armature in a closed configuration of the valve assembly—may be particularly precise due to the arrangement and fixation of the armature stopper and the guide element. Tolerances of the orientation of these surfaces may greatly influence the hydraulic damping of the armature and, thus lead to shot-to-shot and part-to-part deviations of the injected fluid quantity.

Other features which are considered as characteristic for the invention are set forth in the appended claims.

Although the invention is illustrated and described herein as embodied in a valve assembly with a guide element, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

In the exemplary embodiments and figures, similar, identical or similarly acting elements are provided with the same reference symbols. In some figures, individual reference symbols may be omitted to improve the clarity of the figures.

Figure 1:
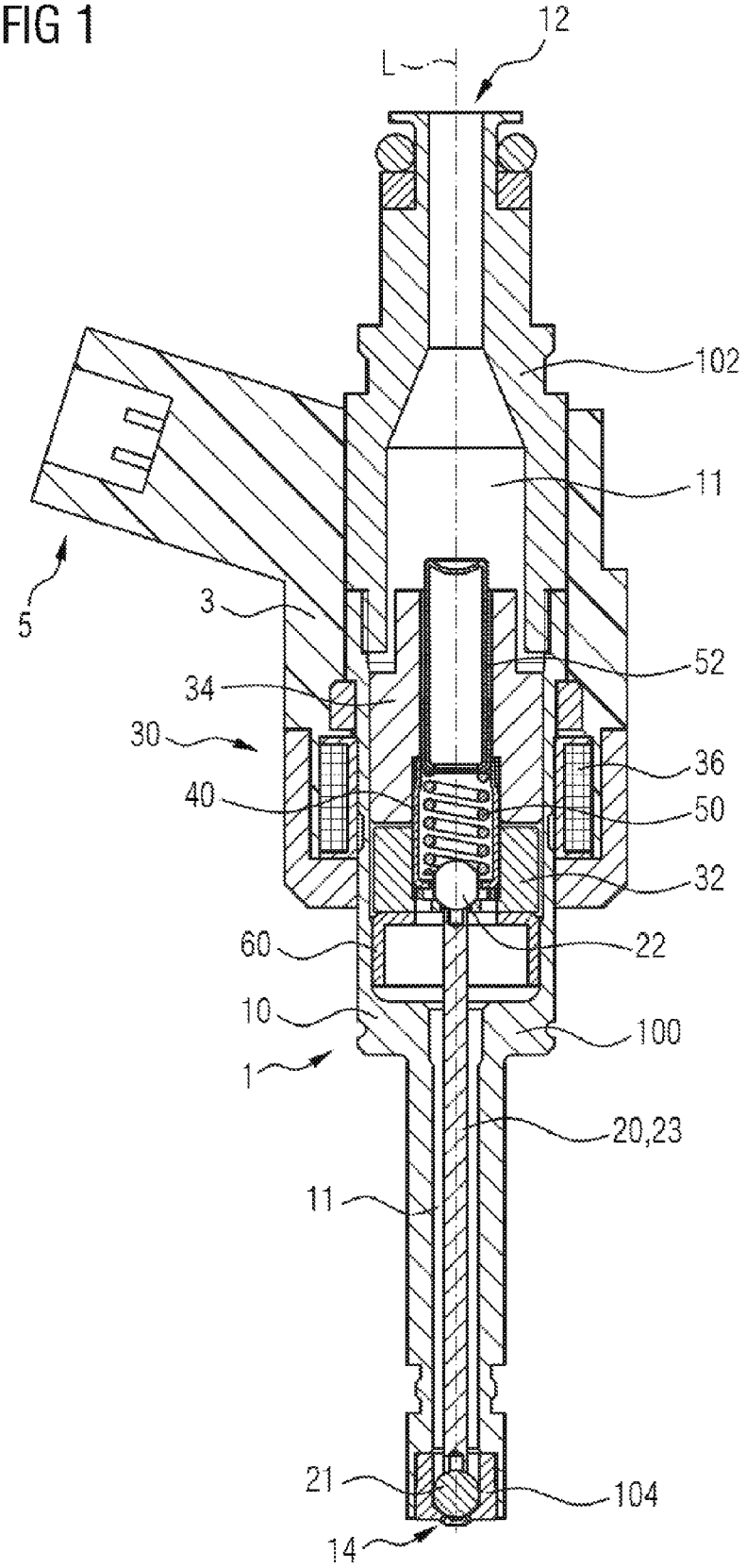
FIG. 1 is a diagrammatic, longitudinal sectional view of a fluid injection valve having a valve assembly according to a first exemplary embodiment of the invention.

Referring now to the figures of the drawings in detail and first, particularly to FIG. 1 thereof, there is shown a longitudinal section view of a fluid injection valve. The fluid injection valve, in the present exemplary embodiment, is a fuel injection valve which is configured for injecting fuel—such as gasoline—directly into a combustion chamber of an internal combustion engine.

Figure 2A:
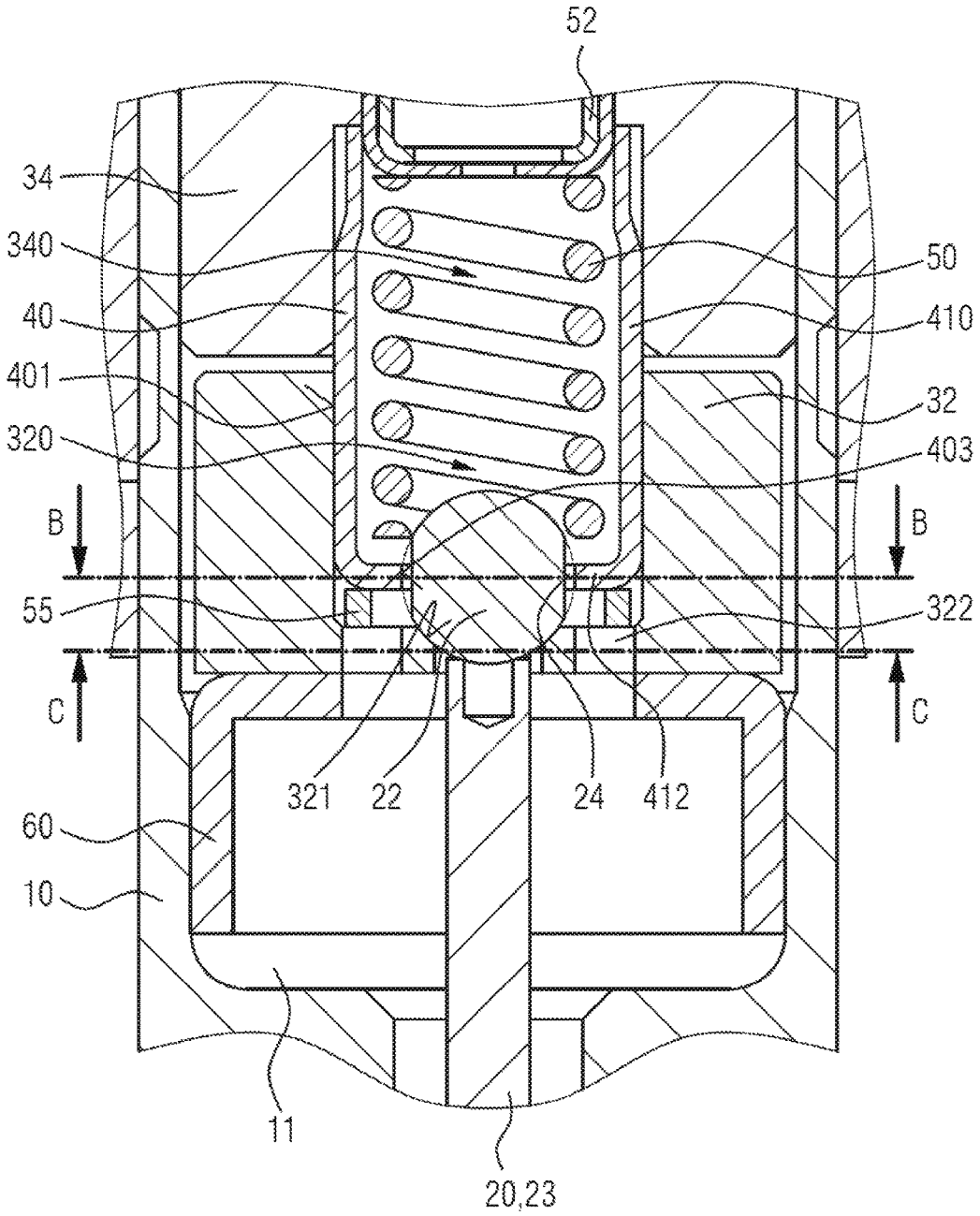
FIG. 2A is a longitudinal sectional view of a detail of the valve assembly according to the first embodiment.

The fuel injection valve contains a valve assembly 1 according to a first exemplary embodiment. A portion of the valve assembly 1 is shown in more detail in the longitudinal section view of FIG. 2A and in the cross-sectional views of the planes IIB-IIB (FIG. 2B) and IIC-IIC (FIG. 2C) which are indicated in FIG. 2A.

The valve assembly 1 has a hollow valve body 10 which extends along a longitudinal axis L and hydraulically connects a fluid inlet 12 at one axial end of the valve body 10 to one or more injection holes 14 at the opposite axial end of the valve body 10. In particular, the valve body 10 has a cavity 11 extending in axial direction through the valve body 10 for leading fluid from the fluid inlet 12 to the injection hole(s) 14. Only for the sake of simplicity, the embodiment will be described below in connection with only one injection hole 14.

In the present embodiment, the valve body 10 is assembled from a plurality of parts, in particular from a main body 100, a fluid inlet tube 102 and a seat element 104. The fluid inlet tube 102 includes the fluid inlet 12 and the seat element 104 includes the injection hole 14. In an alternative embodiment (not shown in the figures), the seat element 104 may be in one piece with the main body 100.

A valve needle 20 is received in the cavity 11 of the valve body 10, in particular it is arranged in the main body 100. The valve needle includes a sealing element 21 and a retainer element 22 at opposite axial ends. A shaft 23 of the valve needle extends from the sealing element 21 to the retainer element 22.

The sealing element 21 is positioned adjacent to the seat element 104. In a closing position of the valve needle 20, the sealing element 21 is in sealing mechanical contact with a valve seat—which is comprised by the seat element 104 in the present embodiment—for preventing fluid flow through the injection hole 14, i.e. for sealing the injection hole 14. In the present embodiment, the sealing element 21 has a spherical basic shape and is a separate part which is fixed to the shaft 23. Other designs are also conceivable, for example the sealing element 21 could be represented by a tip of the shaft 23. The sealing element 21 and the seat element 104 are in sliding mechanical contact—in particular in a region upstream of the valve seat—for axially guiding the valve needle 20 adjacent to its downstream axial end.

The valve needle 20 is axially displaceable in reciprocating fashion relative to the valve body 10 in the cavity 11. In particular, it is axially displaceable away from the closing position to establish a gap between the valve seat and the sealing element 21, i.e. to unseal the injection hole 14.

The valve assembly 1 contains an electromagnetic actuator assembly 30 for displacing the valve needle 20 away from the closing position. The electromagnetic actuator assembly 30 contains a pole piece 34 which is positioned in the cavity 11 of the valve body 10 and connected thereto, for example by a force-fit connection, so that it is positionally fixed relative to the valve body 10. Alternatively, it is also conceivable that the pole piece 34 is in one piece with one part of the valve body 10.

The electromagnetic actuator assembly 30 further contains a movable armature 32. The armature 32 is positioned in the cavity 11 adjacent to the pole piece 34 and movable relative to the pole piece 34 and the valve body 10 in reciprocating fashion.

In addition, the actuator assembly 30 has a magnetic coil 36. The magnetic coil 36 is operable to generate a magnetic field when the actuator assembly 30 is energized. By the magnetic field, the actuator assembly 30 is operable to displace the armature 32 axially towards the pole piece 34. The coil 36 is positioned outside of the valve body 10 and surrounds a portion thereof. It may be positioned in a coil housing and embedded in a molded plastic housing 3 of the fluid injection valve. The plastic housing 3 preferably contains an electrical connector 5 for feeding electrical power to the coil 36.

The armature has a central recess 320. The retainer element 22 of the valve needle 20 is positioned in the central recess 320. The central recess 320 has a bottom surface which is perforated by a through-hole in the armature 32. The shaft 23 of the valve needle 20 extends through the through-hole and projects beyond the armature 32, in the present embodiment in direction towards the sealing element 21. The retainer element 22 projects radially beyond the through-hole so that the retainer element 22 and the bottom surface of the recess 320 are operable to engage in a form-fit connection for displacing the valve needle 20 away from the closing position.

In the present embodiment, the retainer element 22 has a spherical basic shape and the recess 320, in a region adjacent to the through-hole, has a conical contact surface 321 for engaging with the retainer element 22. In this way, by means of the sphere-to-cone interface, the form-fit connection between the retainer element 22 and the armature 32 is particularly insensitive to a tilt of the valve needle 20 relative to the armature 32.

The valve assembly 1 further contains a calibration spring 50 which is seated against the retainer element 22 and against a calibration tube 52 on opposite axial sides. The calibration tube 52 is fixed to the valve body 10—in the present embodiment it is positioned in a central axial opening 340 of the pole piece 34. It is connected to the pole piece 34 by a force-fit connection. In the present embodiment, the calibration tube 52 contains a filter element for filtering the fuel on its way through the cavity 11 from the fluid inlet end 12 to the injection orifice 14.

The calibration spring 50 is preloaded by the calibration tube 52 for biasing the valve needle 20 towards the closing position. When the coil 36 is energized, the actuator assembly 30 is operable to move the valve needle 20 axially away from the closing position against the bias of the calibration spring 50 by an axial movement of the armature 32 towards the pole piece 34 and the mechanical interaction of the armature 32 with the valve needle 20 via the retainer element 22. The axial movement of the armature 32 is stopped when mutually facing impact surfaces of the armature 32 and the pole piece 34 engage into a form-fit engagement.

In order to guide the axial movements of the valve needle 20 and the armature 32, the valve assembly 1 contains a sleeve-shaped guide element 40. The guide element 40 is positionally fixed relative to the pole piece 34 and, thus, to the valve body 10. It is positioned in the central axial opening 340 of the pole piece 34 and axially projects from the central axial opening 340 on the side of the pole piece 34 which faces towards the armature 32 in such fashion that the guide element 40 axially overlaps the armature 32 and the valve needle 20.

Expediently, the central axial opening 340 may have a step on which the guide element 40 bears. The axial position of the guide element 40 may reproducibly be defined in a simple way during manufacturing the valve assembly 1. The guide element 40 is in particular fixed to the pole piece 34 by a form-fit connection and/or a force-fit connection and/or a welded connection.

At least a portion of the calibration spring 50 is arranged inside the sleeve-shaped guide element 40 in the present embodiment. In the present embodiment, the guide element 40 and the calibration tube 52 project from the pole piece 34 on opposite axial sides. In particular the guide element 34 and the calibration tube 52 are shifted into the central axial opening 340 from opposite axial sides of the pole piece 34.

The sleeve-shaped guide element 40 has a cylindrical shell 410 and a lid portion 412. The cylindrical shell 410 extends along the longitudinal axis L with its cylindrical axis coaxial to the longitudinal axis L. The lid portion 412 extends radially inward from the cylindrical portion 410 at that axial end of the cylindrical shell 410 which projects from the pole piece 34.

The guide element has a first guide surface 401 for axially guiding the armature 32 and a second guide surface 403 for axially guiding the valve needle 20. In other words, the first guide surface 401 is in sliding contact with the armature 32 and the second guide surface 403 is in sliding contact with the valve needle 20.

The cylindrical shell 410 of the guide element 40 is partially arranged in the central axial opening 340 of the pole piece 34. It projects axially from the pole piece 34 and into the recess 320 of the armature 32. For axially guiding the armature 32, a circumferential section of the cylindrical outer surface of the cylindrical shell 410 overlaps axially with the recess 320 and mechanically interacts with an inner circumferential surface of the armature 32, the inner circumferential surface defining the recess 320. Thus, the first guide surface 401 is represented by the circumferential section of the cylindrical outer surface of the cylindrical shell 410 in the present embodiment.

The first guide surface 401 and the inner circumferential surface of the recess 320 are parallel to the longitudinal axis and perpendicular to the mutually facing impact surfaces of the armature 32 and the pole piece 34. In this way, a parallel arrangement of the impact surfaces is achieved.

The lid portion 412 axially overlaps the retainer element 22. More specifically, the lid portion 412 has an aperture which extends through the lid portion 412 in axial direction and in which at least a portion of the retainer element 22 is positioned. A cylindrical circumferential surface of the lid portion 412 which faces radially inward and defines the aperture mechanically interacts with the curved surface of the retainer element 22 for axially guiding the valve needle 20 and, thus, represents the second guide surface 403. In the region of the second guide surface 403, the guide element 40—in particular its lid portion 412—is positioned radially between the retainer element 22 and the armature 32. To put it differently, in the region of the second guide surface 403, the retainer element 22, the guide element 40 and the armature 32 follow one another in this order in radial outward direction.

Figure 2B:
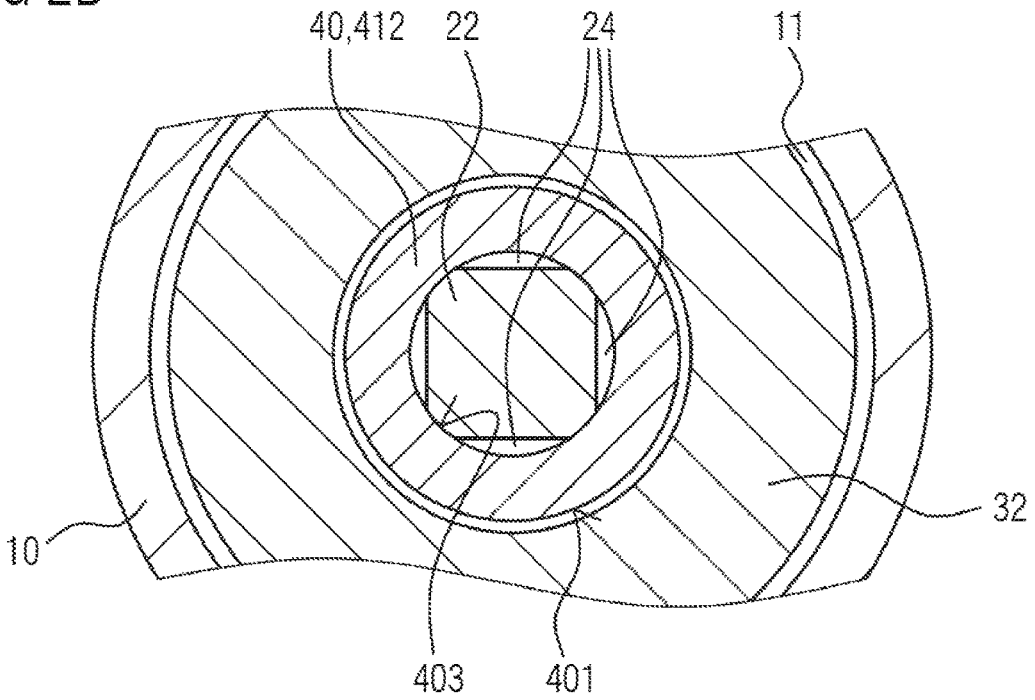
FIG. 2B is a cross-sectional view of the valve assembly according to the first embodiment.

As can be seen best in FIG. 2B, the retainer element 20 deviates from a completely spherical shape in that it is provided with flat surface regions which are parallel to the longitudinal axis L. The aperture of the lid portion 412 of the guide element 40, on the other hand, has a circular contour in top view along the longitudinal axis L, so that by means of the flat surface regions fluid channels 24 are formed between the retainer element 22 and the guide element 40.

Further fluid channels 322 are provided in the armature 32. Preferably, the further fluid channels 322 perforate the bottom surface of the recess 320. In the present embodiment, the further fluid channels 322 are laterally spaced apart from the through-hole through which the shaft 23 of the valve needle 20 projects from the armature 32 (see FIG. 2C).

In this way, a fluid path through the cavity 11 of the valve body 10 is established, such that the fluid is led from the inlet tube 102 through the filter element into the calibration tube 52, through the calibration tube 52, and further into the guide element 40. From the interior of the guide element 40, the fluid is led further through the fluid channels 24 between the guide element 40 and the retainer element 22 into the recess 320 of the armature 32 and from there through the further fluid channels 322 to the injection hole 14.

When the actuator assembly 30 is de-energized, the calibration spring 15 is operable to move the valve needle 20 into the closing position. The valve needle 20, on its way to the closing position, takes the armature 32 with it via the form fit connection with the retainer element 22. The valve assembly 1 is configured such that the armature 32 can move further away from the pole piece 34 when the valve needle 20 impacts the valve seat as it enters into the closing position. The valve assembly 1 contains an armature stopper 60 for limiting the further movement of the armature 32 by a form fit engagement.

The armature stopper 60 is fixed to the valve body 10, for example by a force-fit connection and/or form-fit connection and/or a welded connection. The armature stopper 60 is positioned on the side of the armature 32 remote from the pole piece 34. The armature stopper 60 is spaced apart from the valve needle 20, i.e. it is not in mechanical contact with the valve needle 20. In this way, fluid can pass the armature stopper 60 through a gap between the armature stopper 60 and the valve needle 20 on its way from the fluid inlet 12 to the injection hole 14.

In order to decelerate the movement of the armature 32 away from the pole piece 34 by means of hydraulic damping, the armature 32 and the armature stopper 60 have mutually facing impact surfaces which are parallel to one another, perpendicular to the longitudinal axis L, and have an overlapping area which has a size of at least 30% of the cross-sectional area of the cavity 11 at the axial position of the impact surfaces.

An armature spring 55 is arranged in the recess 320 of the armature 32. It is seated against the bottom surface of the recess 320 and against the lid portion 412 of the guide element 40 on opposite axial sides. The armature spring 55 is preloaded to bias the armature 32 away from the pole piece 34, out of contact with the retainer element 22, and into contact with the armature stopper 60 when the valve needle 20 is in the closing position and the actuator assembly 30 is de-energized.

Figure 2C:
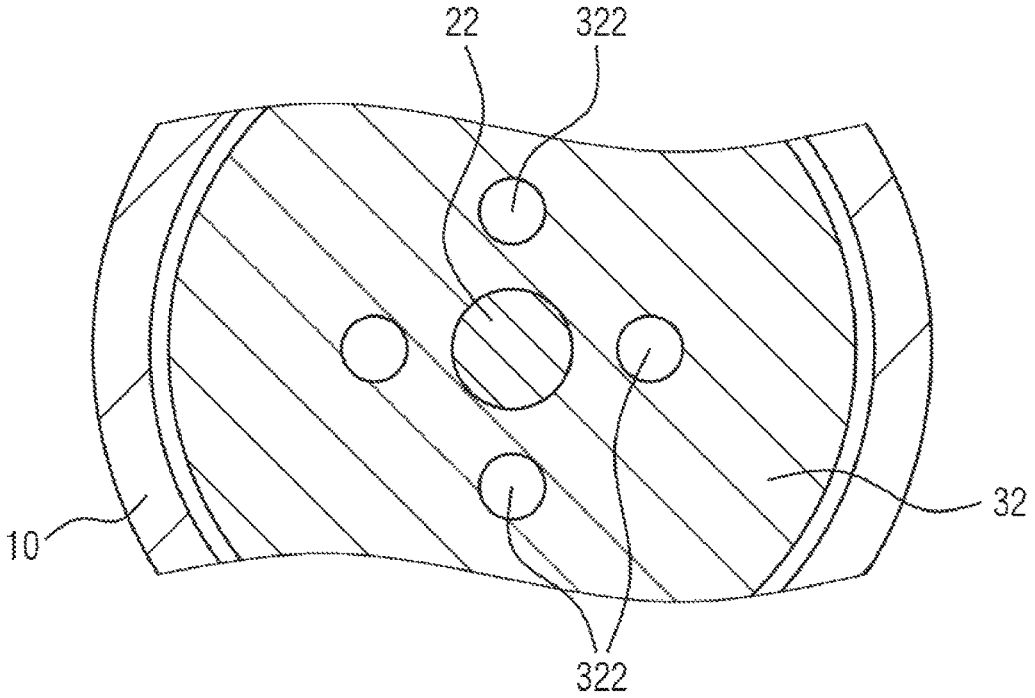
FIG. 2C is a further cross-sectional view of the valve assembly according to the first embodiment.
Figure 3A:
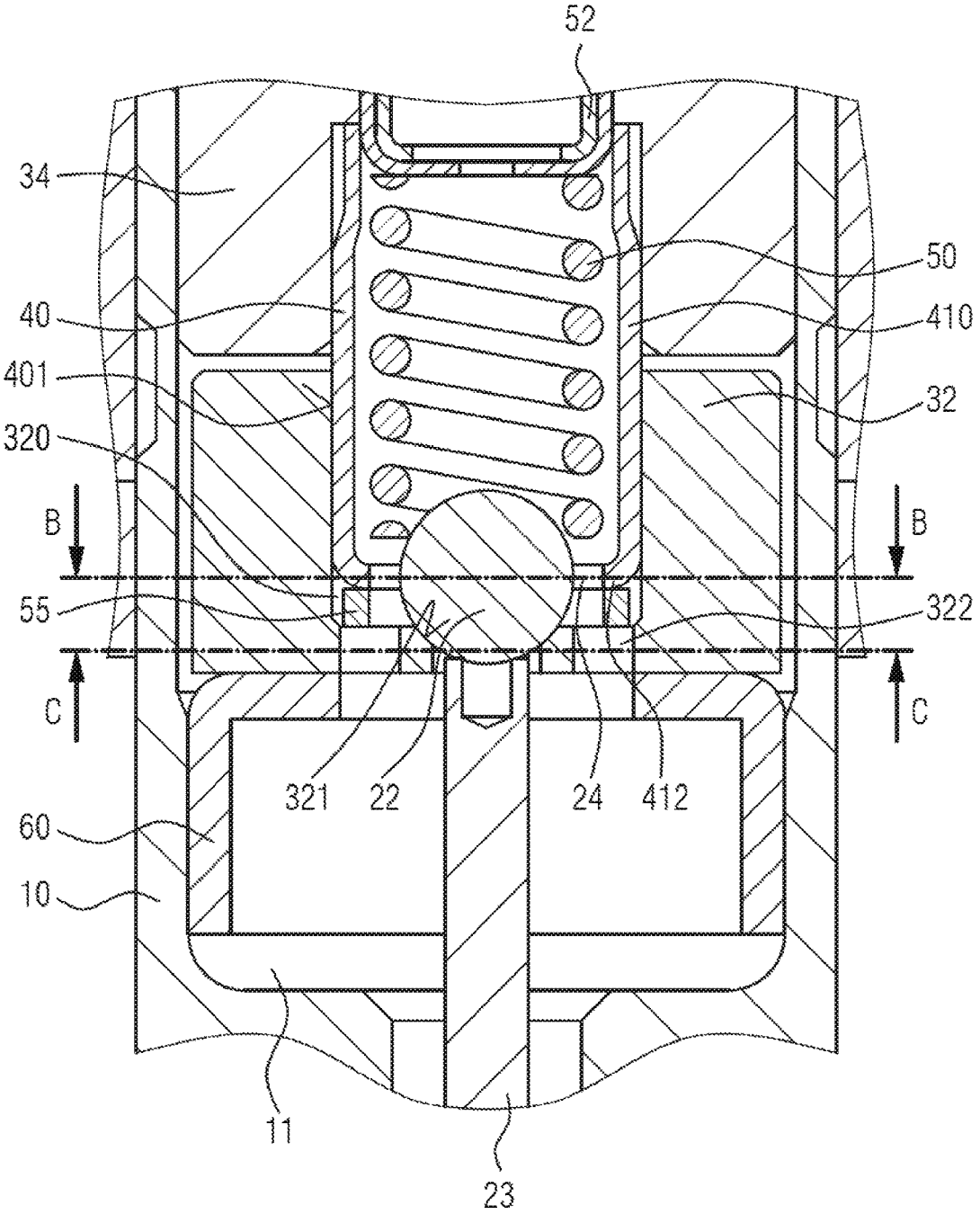
FIG. 3A is a longitudinal sectional view of a detail of a valve assembly according to a second embodiment.
Figure 3B:
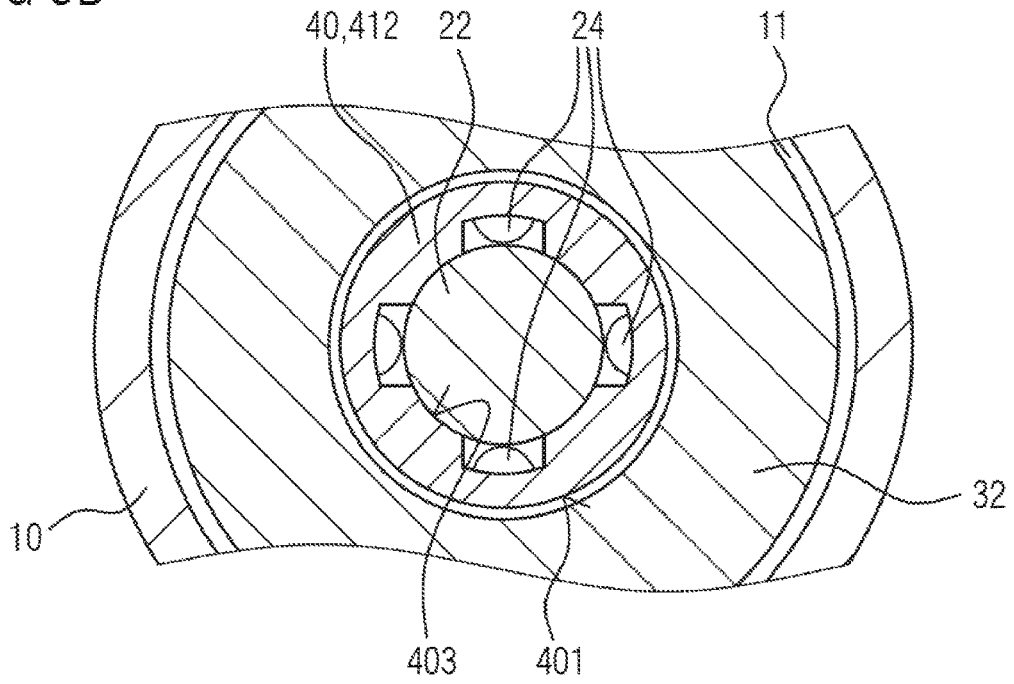
FIG. 3B is a cross-sectional view of the valve assembly according to the second embodiment.
Figure 3C:
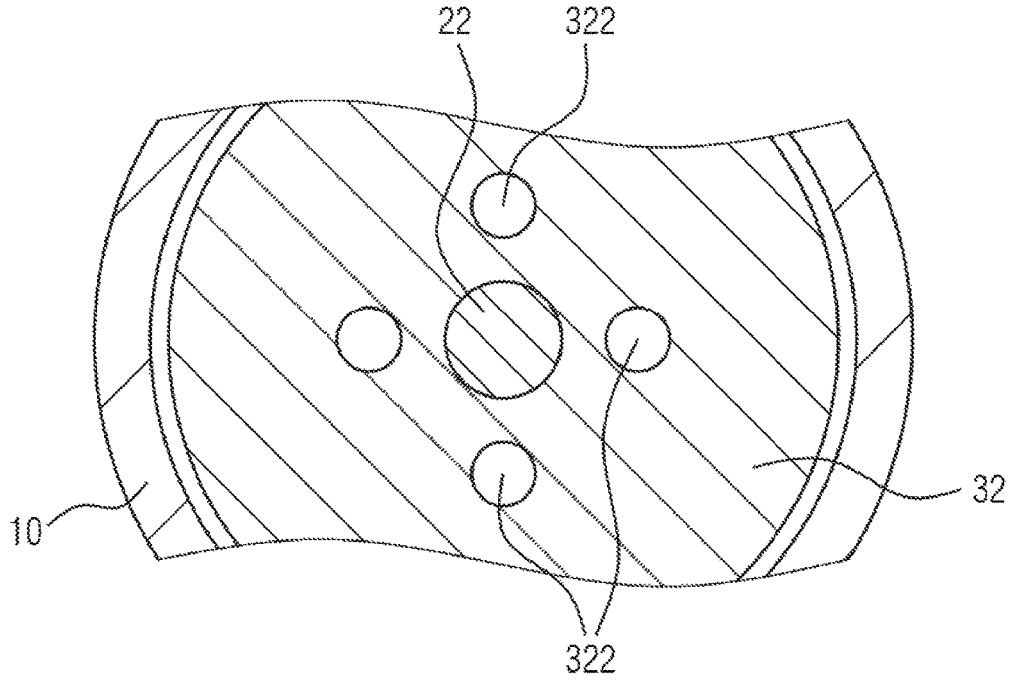
FIG. 3C is a further cross-sectional view of the valve assembly according to the second embodiment.

FIGS. 3A, 3B, and 3C show a second exemplary embodiment of the valve assembly 1 in a longitudinal section view corresponding to that of FIG. 2A and in cross-sectional views corresponding to those of FIGS. 2B and 2C.

The valve assembly 1 according to the second exemplary embodiment corresponds in general to the valve assembly 1 according to the first embodiment. However, in the present embodiment the fluid channels 24 between the guide element 40 and the retainer element 22 are not realized by means of flat surface regions of the retainer element 22. Rather, the retainer element 22 has a spherical shape without flats, so that it has a circular outer contour in the cross-sectional view of FIG. 3B. Instead, the fluid channels 24 are formed by means of cutouts in the lid portion 412 of the guide element 40, the cutouts extending axially through the lid portion 412.

Figure 4A:
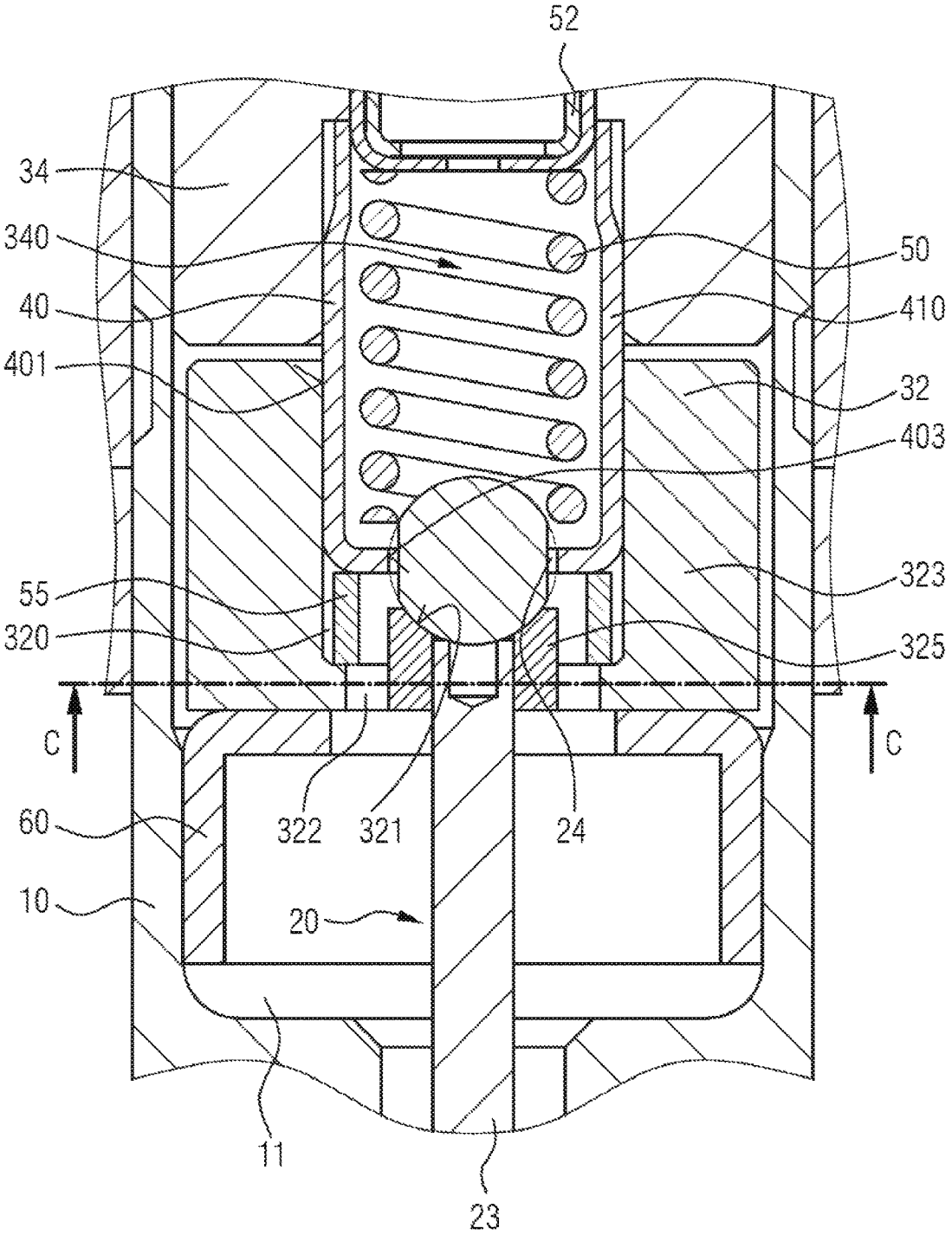
FIG. 4A is a longitudinal sectional view of a detail of the valve assembly according to a third embodiment.
Figure 4B:
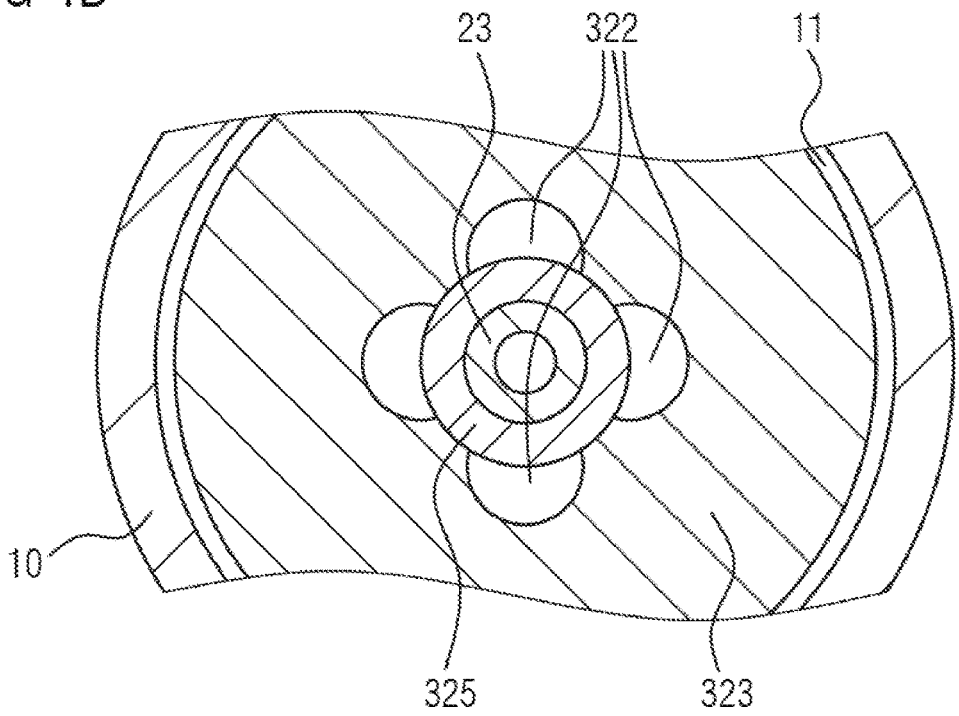
FIG. 4B is a cross-sectional view of the valve assembly according to the third embodiment.

A valve assembly 1 according to a third exemplary embodiment is shown in FIGS. 4A and 4B. The valve assembly 1 according to the third embodiment corresponds in general to the valve assembly 1 of the first embodiment. The longitudinal sectional view of FIG. 4A corresponds in general to the longitudinal sectional view of FIG. 2A and the cross-sectional view of FIG. 4B in the plane IVB-IVB which is shown in FIG. 4A corresponds in general to the cross-sectional view of FIG. 2C.

While the armature 32 is a one-piece element in the first exemplary embodiment, it contains a main part 323 and a bushing 325 in the present embodiment. The bushing 325 is positioned radially between the valve needle 20 and the main part 323 in some places. For example, the main part 323 contains the recess 320 and the bushing 325 extends through the bottom surface of the recess 320 for defining the through-hole through which the valve needle 20 axially extends. In particular, the conical contact surface 321 is comprised by the bushing 325 in the present embodiment. The further fluid channels 325 may, for example, be formed by cutouts in the main part 323 at the interface of the main part 323 with the bushing 325.

Expediently, the bushing 325 consists of a harder material than the main part 323 of the armature 32. In this way, undesirable wear at the form fit connection between the retainer element 22 and the bushing 325 may be particularly small.

The invention is not limited to specific embodiments by the description on basis of these exemplary embodiments. Rather, it contains any combination of elements of different embodiments. Moreover, the invention comprises any combination of claims and any combination of features disclosed by the claims.

The invention claimed is:

1. A valve assembly for a fluid injection valve, the valve assembly comprising:

a fluid inlet;

an injection orifice;

a hollow valve body hydraulically connecting said fluid inlet to said injection orifice and having a longitudinal axis;

a valve needle received in said valve body in an axially displaceable fashion for sealing said injection orifice in a closing position and unsealing said injection orifice in other positions;

an electromagnetic actuator assembly for displacing said valve needle away from the closing position, said electromagnetic actuator assembly having a movable armature and a pole piece being positionally fixed relative to said hollow valve body; and a guide element positionally fixed relative to said pole piece, said guide element having a first guide surface for axially guiding said movable armature and a second guide surface for axially guiding said valve needle;

said guide element being in a shape of a sleeve having an outer circumferential surface and an inner circumferential surface, said first and second guide surfaces being comprised by said outer circumferential surface and said inner circumferential surface of said sleeve, respectively.

2. The valve assembly according to claim 1, wherein said pole piece has a central axial opening formed therein and in which said guide element is partially disposed and from which said guide element projects.

3. The valve assembly according to claim 1, wherein:

said valve needle has a retainer element, said retainer element and said movable armature are operable to engage in a form-fit connection for displacing said valve needle away from the closing position; and said retainer element mechanically interacts with said second guide surface of said guide element for axially guiding said valve needle.

4. The valve assembly according to claim 3, wherein said retainer element has a spherical basic shape and said movable armature has a conical contact surface for engaging with said retainer element.

5. The valve assembly according to claim 3, further comprising at least one fluid channel being formed between said retainer element and said guide element.

6. The valve assembly according to claim 3, wherein:

said movable armature has a central recess formed therein;

said retainer element is disposed in said central recess;

said guide element projects axially from said pole piece into said central recess; and said guide element is positioned radially between said retainer element and said movable armature at least in a region of said second guide surface.

7. The valve assembly according to claim 1, wherein said movable armature has a main part and a bushing, said bushing is positioned radially between said valve needle and said main part in some places, and said bushing having a conical contact surface.

8. The valve assembly according to claim 1, further comprising:

a calibration spring for biasing said valve needle towards the closing position; and an armature spring for biasing said movable armature away from said pole piece.

9. The valve assembly according to claim 1, further comprising an armature stopper being disposed in said hollow valve body on a side of said movable armature remote from said pole piece, being positionally fixed relative to said hollow valve body and operable to limit axial displacement of said movable armature away from said pole piece.

10. A fluid injection valve, comprising:

a valve assembly, said valve assembly including:

a fluid inlet;

an injection orifice;

a hollow valve body hydraulically connecting said fluid inlet to said injection orifice and having a longitudinal axis;

a valve needle received in said hollow valve body in an axially displaceable fashion for sealing said injection orifice in a closing position and unsealing said injection orifice in other positions;

an electromagnetic actuator assembly for displacing said valve needle away from the closing position, said electromagnetic actuator assembly having a movable armature and a pole piece which is positionally fixed relative to said hollow valve body; and a guide element positionally fixed relative to said pole piece, said guide element having a first guide surface for axially guiding said movable armature and a second guide surface for axially guiding said valve needle;

said guide element being in a shape of a sleeve having an outer circumferential surface and an inner circumferential surface, said first and second guide surfaces being comprised by said outer circumferential surface and said inner circumferential surface of said sleeve, respectively.

11. A valve assembly for a fluid injection valve, the valve assembly comprising:

a fluid inlet;

an injection orifice;

a hollow valve body hydraulically connecting said fluid inlet to said injection orifice and having a longitudinal axis;

a valve needle received in said valve body in an axially displaceable fashion for sealing said injection orifice in a closing position and unsealing said injection orifice in other positions;

an electromagnetic actuator assembly for displacing said valve needle away from the closing position, said electromagnetic actuator assembly having a movable armature and a pole piece being positionally fixed relative to said hollow valve body; and a guide element positionally fixed relative to said pole piece, said guide element having a first guide surface for axially guiding said movable armature and a second guide surface for axially guiding said valve needle;

wherein said pole piece has a central axial opening formed therein and in which said guide element is partially disposed and from which said guide element projects.

12. The valve assembly according to claim 11, wherein said pole piece has a central axial opening formed therein and in which said guide element is partially disposed and from which said guide element projects.

13. The valve assembly according to claim 11, wherein:

said valve needle has a retainer element, said retainer element and said movable armature are operable to engage in a form-fit connection for displacing said valve needle away from the closing position; and said retainer element mechanically interacts with said second guide surface of said guide element for axially guiding said valve needle.

14. The valve assembly according to claim 13, wherein said retainer element has a spherical basic shape and said movable armature has a conical contact surface for engaging with said retainer element.

15. The valve assembly according to claim 13, further comprising at least one fluid channel being formed between said retainer element and said guide element.

16. The valve assembly according to claim 13, wherein:

said movable armature has a central recess formed therein;

said retainer element is disposed in said central recess;

said guide element projects axially from said pole piece into said central recess; and said guide element is positioned radially between said retainer element and said movable armature at least in a region of said second guide surface.

17. The valve assembly according to claim 11, wherein said movable armature has a main part and a bushing, said bushing is positioned radially between said valve needle and said main part in some places, and said bushing having a conical contact surface.

18. The valve assembly according to claim 11, further comprising:

a calibration spring for biasing said valve needle towards the closing position; and an armature spring for biasing said movable armature away from said pole piece.

19. The valve assembly according to claim 11, further comprising an armature stopper being disposed in said hollow valve body on a side of said movable armature remote from said pole piece, being positionally fixed relative to said hollow valve body and operable to limit axial displacement of said movable armature away from said pole piece.

* * * * *